US010472112B2

(12) United States Patent
Ehrmann

(10) Patent No.: US 10,472,112 B2
(45) Date of Patent: Nov. 12, 2019

(54) THERMOFORM PACKAGING MACHINE WITH STRIP PUNCH UNIT

(71) Applicant: MULTIVAC Sepp Haggenmüller SE & Co. KG, Wolfertschwenden (DE)

(72) Inventor: Elmar Ehrmann, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 79 days.

(21) Appl. No.: 15/140,124

(22) Filed: Apr. 27, 2016

(65) Prior Publication Data

US 2016/0318643 A1 Nov. 3, 2016

(30) Foreign Application Priority Data

Apr. 30, 2015 (EP) ..... 15165942

(51) Int. Cl.

| | |
|---|---|
| ***B65B 61/06*** | (2006.01) |
| ***B26F 1/14*** | (2006.01) |
| ***B65B 65/00*** | (2006.01) |
| ***B65B 65/02*** | (2006.01) |
| ***B65B 9/04*** | (2006.01) |
| ***B26D 7/32*** | (2006.01) |

(52) U.S. Cl.

CPC ..... *B65B 61/065* (2013.01); *B26D 7/32* (2013.01); *B26F 1/14* (2013.01); *B65B 9/04* (2013.01); *B65B 65/003* (2013.01); *B65B 65/02* (2013.01)

(58) Field of Classification Search

CPC ..... B26D 1/065; B26D 1/085; Y10T 83/9478; Y10T 83/8739; Y10T 83/8835; Y10T 83/9476; B65B 61/065; B65B 65/02; B65B 65/003; B26F 1/14

USPC ..... 83/405, 515, 681–691, 698.91, 699.11, 83/600, 623, 557, 167, 109

See application file for complete search history.

(56) References Cited

U.S. PATENT DOCUMENTS

| | | | | | |
|---|---|---|---|---|---|
| 461,950 | A * | 10/1891 | Cranston | B26D 7/025 | 83/378 |
| 2,071,001 | A * | 2/1937 | Rode | B21D 24/12 | 72/408 |
| 2,281,439 | A * | 4/1942 | Heftler | B21D 28/06 | 83/213 |
| 2,534,780 | A * | 12/1950 | Lovenheim | B21D 43/13 | 271/246 |
| 2,736,379 | A * | 2/1956 | Winn | B26F 1/02 | 234/78 |
| 2,825,405 | A * | 3/1958 | Maass | B23D 15/02 | 83/590 |

(Continued)

FOREIGN PATENT DOCUMENTS

| | | |
|---|---|---|
| CN | 203832775 U | 9/2014 |
| DE | 10351567 A1 | 6/2005 |

(Continued)

*Primary Examiner* — Laura M Lee

(74) *Attorney, Agent, or Firm* — Husch Blackwell LLP

(57) ABSTRACT

The present invention relates to a thermoform packaging machine comprising a film punch unit that includes a stroke drive for moving a die and a punch. The die and punch are movable, by means of the stroke drive, towards and away from each other orthogonally to a film conveying plane. The stroke drive is arranged above the film conveying plane.

19 Claims, 4 Drawing Sheets

(56) References Cited

U.S. PATENT DOCUMENTS 3,186,284 A * 6/1965 Bennett ..... B21D 37/10 29/520
3,207,406 A * 9/1965 Bowman ..... B27F 7/155 100/231
3,421,397 A * 1/1969 Clark ..... B30B 1/261 100/292
3,529,502 A * 9/1970 Krynytzky ..... B21D 24/14 83/137
3,724,308 A * 4/1973 Nichols ..... B26D 5/08 83/557
3,948,131 A * 4/1976 Yatsenko ..... B22D 11/126 83/308
4,622,798 A 11/1986 Oki
5,848,568 A * 12/1998 Imanishi ..... B30B 1/106 100/257
5,916,345 A * 6/1999 Kobayashi ..... B30B 1/10 100/272
6,012,370 A * 1/2000 Kobayashi ..... B30B 1/14 100/272
6,067,886 A * 5/2000 Irwin ..... B26D 5/14 100/282
6,254,378 B1 * 7/2001 Berghoff ..... B29C 31/006 425/451.2
6,314,852 B1 * 11/2001 Long ..... B26D 7/26 100/219
6,435,067 B1 * 8/2002 Irwin ..... B26D 7/01 264/153
6,477,945 B1 11/2002 Imanishi et al.
6,990,896 B2 * 1/2006 White ..... B30B 1/18 100/289

FOREIGN PATENT DOCUMENTS

DE 102004024358 A1 12/2005
DE 102005010203 A1 9/2006
DE 102006045477 A1 4/2008
DE 102006017258 B4 7/2011
DE 102012204502 A1 9/2013
EP 1193046 A1 4/2002
EP 1361157 A1 11/2003
EP 2447171 A1 5/2012
WO 2013102682 A1 7/2013

* cited by examiner

THERMOFORM PACKAGING MACHINE WITH STRIP PUNCH UNIT

CROSS-REFERENCE TO RELATED APPLICATIONS

This Application claims priority to European Patent Application Number 15165942.2 filed Apr. 30, 2015, to Elmar Ehrmann, currently pending, the entire disclosure of which is incorporated herein by reference.

FIELD OF THE INVENTION

The present invention relates to a thermoform packaging machine.

BACKGROUND OF THE INVENTION

In thermoform packaging machines, a receptacle or a trough is normally formed into a bottom film/foil in a forming station, the trough being then filled with a product and hermetically sealed with a top film in a sealing station under vacuum and/or under a modified atmosphere. The packages produced in this way constitute a compound, which is interconnected via the bottom film, and are conveyed through the thermoform packaging machine by means of clamp chains provided on both sides thereof. For singulating the packages from the compound of bottom and top films, a combination comprising a cross cutting station and a subsequent longitudinal cutting station may be provided. In the cross cutting station, the compound of bottom and top films is cut in a direction transversely to the conveying direction or strip cuts are punched out, if radii should be necessary on the edges of the packages.

Since normally there is not sufficient space for a unit for collecting the strip cuts within the machine frame or for removing them from the machine frame, the punching knife will usually punch the strip cuts out of the film from below in an upward direction. These strip cuts will then be pushed further up in a receiving container after each step and can finally be removed in one go. In high-performance machines, the receiving containers are very high so that they need not be emptied constantly. The strip cuts are here pushed over a projection, which is located above a film conveying plane and on which part of the strip cut punched out last rests with its edge thus preventing the strip cuts stacked thereabove from dropping into the cross cutting station and on the packages to be cut. In the latter case, malfunctions and downtimes would also be caused in the thermoform packaging machine.

Especially if the strip cuts in question are comparatively thin or not flexurally rigid, there will be a high risk that the weight of the stacked strip cuts cannot be held by the lowermost supported strip cut.

EP 2 447 171 A1 discloses a solution for reliably disposing of cutting waste that is discharged upwards, i.e., above the film conveying plane.

SUMMARY OF THE INVENTION

It is the object of the present invention to provide a thermoform packaging machine comprising an improved strip punch unit.

The thermoform packaging machine according to one embodiment of the present invention comprises a film punch unit including a joint stroke drive for a die and a punch. The die and the punch may be movable towards one another, orthogonally to a film conveying plane, by means of the joint stroke drive. A first stroke mechanism can transmit the driving movement of the stroke drive to the punch, while a second stroke mechanism can transmit the driving movement of the stroke drive to a movement of the die. The stroke movements executed by the punch and the die are preferably movements in opposite directions. The thermoform packaging machine according to one embodiment of the present invention is characterized in that the stroke drive is arranged above the film conveying plane. Cut-out strip cuts can thus drop directly into a container or onto a discharge belt, without contaminating the stroke drive or negatively interfering therewith.

The stroke drive can comprise an electric motor, such as a servo motor, which may optionally be provided with a brake. In the case of a conventional stroke drive comprising a pneumatic cylinder, a film punch unit occupies, in an inoperative state, an open position. In the event of a pressure drop in the supply lines of the pneumatic cylinder of a conventional stroke drive, there is a risk that the operator may be injured by an unexpected downward movement of an upper tool of the film punch unit. An electric motor, however, may drive a self-locking stroke spindle or it may have a brake so that, at an inoperative position of the film punch unit, there will be no risk for the operating or maintenance staff. In order to monitor or test the function of the brake, the control unit of the thermoform packaging machine may operate the electric motor at a defined torque, with the brake engaged, and test whether a non-admissible movement occurs.

The first stroke mechanism may be arranged fully above the film conveying plane. The second stroke mechanism, however, may be provided with guide rods, which are located laterally and outside of the film conveyed in the film punch unit. A driving movement of the stroke drive can be transmitted by means of the guide rods to the die located below the film conveying plane.

The film punch unit may have a frame that is arranged on a machine frame of the thermoform packaging machine in a stationary manner. As a component of the second stroke mechanism, a bearing plate may be provided, which moves up and down relative to the frame of the film punch unit when the film punch unit is in operation. The stroke movement of the die located below the film plane may be coupled to the movement of the bearing plate. According to one embodiment, the stroke drive is rigidly secured to the frame, so that the bearing plate moves relative to the frame. According to another embodiment, however, the motor is secured to the bearing plate, so that, when the film punch unit is in operation, the motor will move alternatingly up and down together with the bearing plate relative to the frame of the film punch unit.

The punch may include a punching knife.

The die can have an opening which allows the punching knife to enter the die. The opening may be produced by means of wire eroding and/or by means of grinding.

The punch and the punching knife can each be configured as a multi-part component, so that comparatively large dimensions of the punch and punching knife can be provided and so that the individual parts can be adjusted relative to one another.

The die may comprise a plurality of cavities so as to avoid collisions with the receptacles formed in the bottom film, since the die has crosspieces used for the purpose of stabilization and oriented in the working direction of the thermoform packaging machine.

In one embodiment, the cavities have a height of up to 60 mm in the vertical direction and/or a depth of 30 mm to 40 mm in the horizontal direction, so as to be also suitable for processing receptacles having large thermoformed depth dimensions.

The film punch unit can be configured for separating a film strip from a composite film by means of the punch and the die and for conveying it downwards through the die, so as to avoid the necessity of having to lift an accumulation of film strips upwards and to collect and/or stack them, for example, in containers.

The punch may be configured such that it is movable vertically downwards and the die such that it is movable vertically upwards, for executing the punching process.

The film punch unit can be configured for executing the movement of the punch and die simultaneously to the greatest possible extent, so as to keep the cycle time of the film punch unit as short as possible and simplify the construction with only one electric motor.

According to one embodiment, a container is provided below the die and the film punch unit, respectively, for receiving the film strips therein. The container may be provided with a filling level monitoring unit communicating, for example, with the control unit of the thermoform packaging machine, so as to indicate to the operator the information that exchanging or emptying the container may be necessary or may become necessary in the near future.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the present invention will be explained in more detail making reference to the drawing, in which the individual figures show.

Like components are designated by like reference numerals throughout the figures.

DETAILED DESCRIPTION OF THE INVENTION

Figure 1:
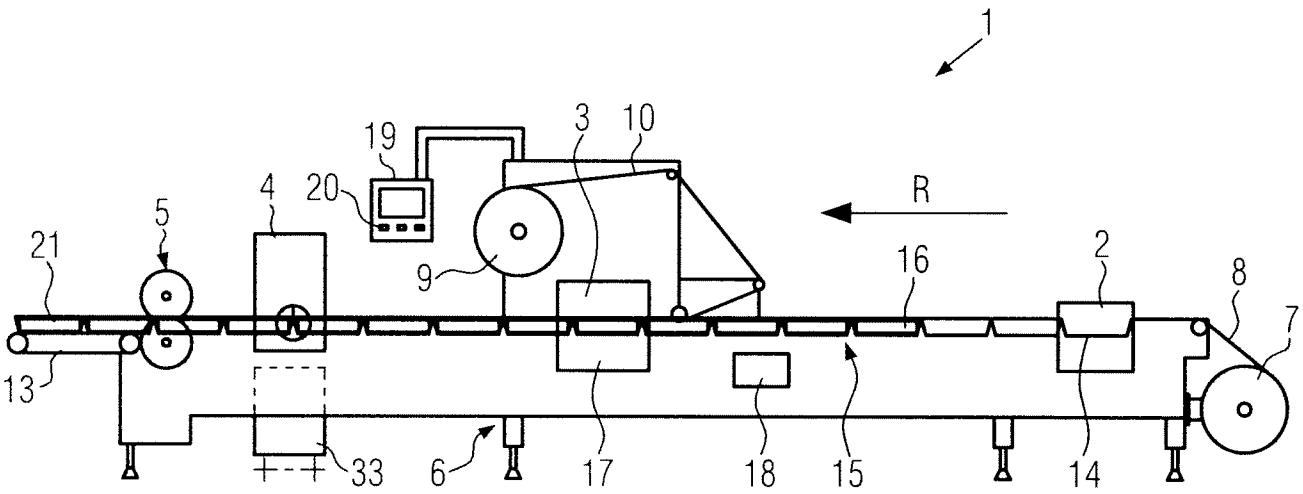
FIG. 1 is a schematic side view of a thermoform packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic side view of a packaging machine according to one embodiment of the present invention in the form of a thermoform packaging machine 1. As shown, the thermoform packaging machine 1 comprises a forming station 2, a sealing station 3, a cross cutting station 4 and a longitudinal cutting station 5 arranged, in this order, on a machine frame 6 in a working direction R. On the input side, the machine frame 6 may have provided thereon a supply roll 7 from which a bottom film/foil 8 is unwound. In the area of the sealing station 3, a material storage unit 9 can be provided, from which a top film 10 is unwound. On the output side, a discharge unit 13 in the faun of a conveyor belt may be provided at the packaging machine, with which finished, singulated packages 21 can be transported away. Furthermore, the thermoform packaging machine 1 may comprise a feeding device, which is not shown, the feeding device gripping the bottom film 8 and advancing it clockwise in the working direction R in a main work cycle. The feeding device may include laterally arranged transport chains and may transport the bottom film 8.

In the embodiment shown, the forming station 2 is configured as a thermoforming station, in which receptacles 14 are formed in the bottom film 8 by thermoforming. The forming station 2 may be configured such that, in the direction perpendicular to the working direction R, several receptacles 14 are formed side by side. Downstream of the forming station 2, when seen in the working direction R, an infeed line 15 can be provided, along which the receptacles 14 formed in the bottom film 8 are filled with products 16.

The sealing station 3 can include a closable chamber 17, in which the atmosphere in the receptacle 14 can be substituted, prior to sealing, by an exchange gas or by an exchange gas mixture, for example, through gas flushing.

The cross cutting station 4 may be configured as a film punch unit or, more precisely, as a strip punch unit separating the bottom film 8 and the top film 10 in a direction transversely to the working direction R between neighboring receptacles 14. In so doing, the cross cutting station 4 may work such that the bottom film 8 is not cut across the whole width, but instead remains uncut in at least an edge area thereof and between two neighboring receptacles 14. This allows controlled further transport of the receptacles 14 by the feeding device.

In the embodiment shown, the longitudinal cutting station 5 is configured as a blade. The bottom film 8 and the top film 10 may be cut between neighboring receptacles 14 and at the lateral edge of the bottom film 8, so that, downstream of the longitudinal cutting station 5, singulated packages 21 are obtained. Below the cross cutting unit 4, a movable container 33 can be provided for receiving punching waste therein.

The packaging machine 1 may additionally be provided with a control unit 18. The control unit 18 may be used for controlling and monitoring the processes taking place in the packaging machine 1. A display device 19 with operating controls 20 may serve to make the sequences of the process steps in the thermoform packaging machine 1 visible to an operator and may serve to influence them by the operator.

The general mode of operation of the packaging machine 1 according to one embodiment will be described briefly in the following:

The bottom film 8 may be unwound from the supply roll 7 and conveyed into the forming station 2 by the feeding device. In the forming station 2, receptacles 14 can be formed in the bottom film 8 by thermoforming. Together with the material of the bottom film 8 surrounding them, the receptacles 14 may be advanced, in a main work cycle, to the infeed line 15 where they are filled with products 16.

Subsequently, the filled receptacles 14, together with the area of the bottom film 8 surrounding them, may be advanced by the feeding device into the sealing station 3 in the main work cycle. After having been sealed onto the bottom film 8, the top film 10 can be advanced through the feed motion of the bottom film 8. In the course of this process, the top film 10 may be unwound from the material storage unit 9. By sealing the top film 10 onto the receptacles 14, closed packages 21 are obtained.

Figure 2:
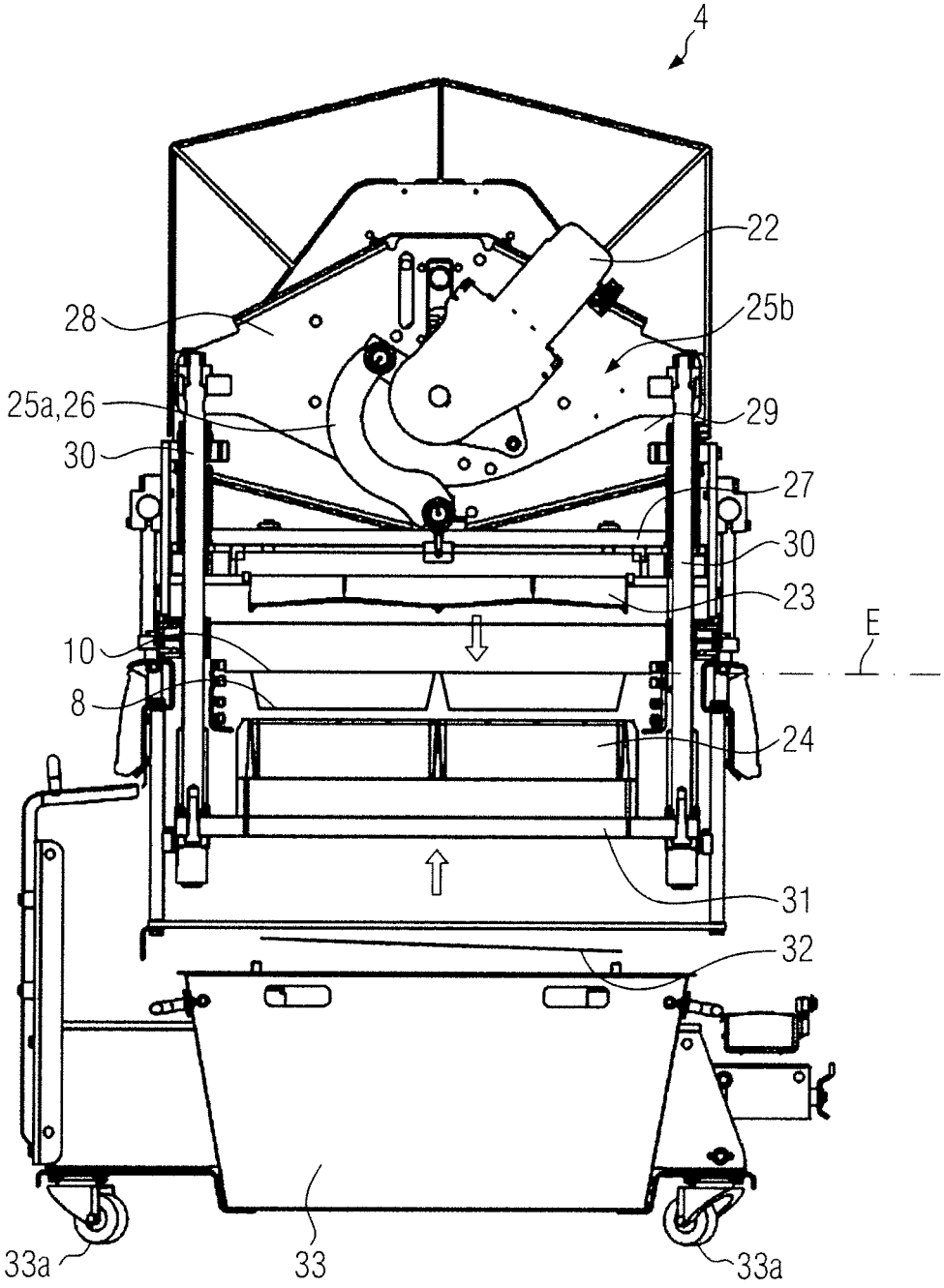
FIG. 2 is a schematic view in the working direction of a cross cutting station according to one embodiment of the present invention.

FIG. 2 shows the cross cutting station 4 in the form of a film punch unit, which, by means of an electric-motor-operated stroke drive 22, for example, a servo drive or a servo motor, moves a punch 23 downwards against the bottom film 8 and the top film 10 forming together a composite film, and, in so doing, separates a film strip 32 from the composite film comprising the bottom film 8 and the top film 10. The punch 23 may cooperate with a die 24. The die 24, by means of the stroke drive 22, may be moved against the bottom film 8 and the top film 10 simultaneously with and in a direction opposite to the punch 23. The stroke drive 22 may be configured for moving a plate 27, which has the punch 23 attached thereto, downwards through a first stroke mechanism 25*a*. The first stroke mechanism 25*a* may be in the form of a curved push rod 26. The motor 22 can be supported on a bearing plate 28. Simultaneously, the motor 22 causes, due to its driving power, the bearing plate 28 to move upwards relative to a frame 29 of the cross cutting station 4, the frame 29 being arranged on the machine frame 6 in a stationary manner.

Through at least two guide rods 30, arranged on the left and right sides in the drawing, a stroke plate 31 having the die 24 attached thereto may be rigidly connected to the bearing plate 28, so that the movement of the die 24 corresponds to the movement of the bearing plate 28. The bearing plate 28, the at least two guide rods 30 and the stroke plate 31 can define together a second stroke mechanism 25*b* by means of which the driving movement of the stroke drive 22 is converted into a stroke movement of the die 24. The stroke drive 22 thus ensures that the punch 23 and the die 24 jointly move towards each other for cutting out the film strip 32 and that the punch 23 and the die 24 will then also move away from each other, so as to allow another film advance.

After the film strip 32 has been cut out, it is pressed down through the die 24 by means of the punch 23 and can drop downwards into the mobile container 33, which may be provided with wheels 33*a* and disposed below the cross cutting unit 4. The container 33 may be sensorially examined by the control unit 18, as to whether it occupies its predefined operating position below the cross cutting unit 4, since it is intended to prevent, also for safety reasons, the operator from reaching into the cross cutting unit 4 from below through the machine frame 6 while the thermoform packaging machine 1 is running.

An alternative embodiment without such a container 33 is also imaginable, wherein the container is replaced by a conveyor belt conveying the film strips out of the thermoform packaging machine 1 in a direction laterally to the working direction R and supplying them to a waste disposal unit.

The film conveying plane E may be defined by the composite film comprising the bottom film 8 and the top film 10 as well as by the orientation in the working direction R. Both the stroke drive 22 and the stroke mechanism 25*a* may be fully located above the film conveying plane E.

Figure 3:
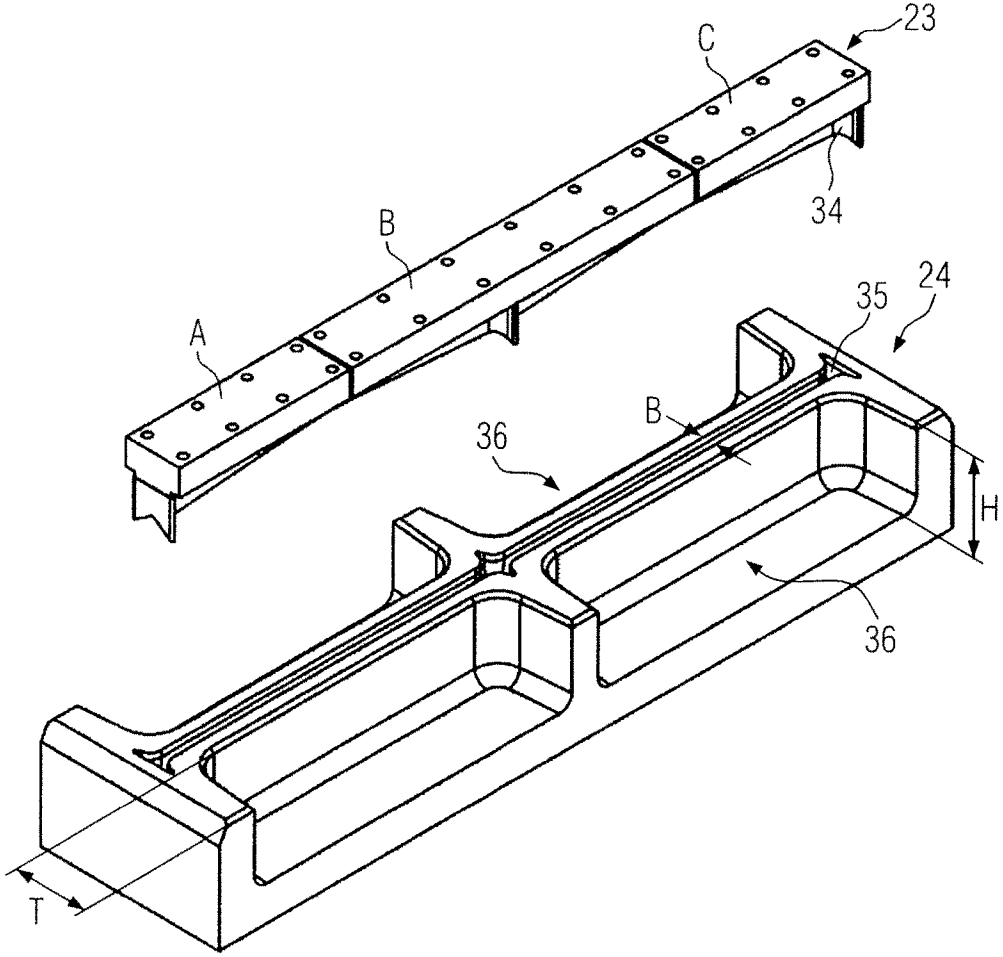
FIG. 3 is a schematic prospective view of a punch and a die according to one embodiment of the present invention.

FIG. 3 shows the punch 23 and the die 24. As shown, the die 24 has an opening 35 which is congruent with the contour of a punching knife 34 of the punch 23. The film strip 32 cut out of the composite film can drop downwards through the opening 35 of the die 24 or it can be pressed downwards into the opening 35 by means of the punching knife 34. The punch 23 and the punching knife 34 can be configured as multi-part components consisting of a plurality of interconnected parts A, B and C.

The die 24 is an integral component and may be made of stainless steel or of some other hardened steel and the opening 35 can be produced by means of wire eroding, for example. The die 24 may comprise four cavities 36 used as free spaces in the die 24 for the packages 21 and the receptacles 14, respectively. The cavities 36 may have a height H of up to about 60 mm and, in the horizontal direction, a depth T of about 30 to about 40 mm so as to impart high stability to the die 24. The opening 35 can have a width B of about 5 to about 10 mm in the area where the width is smallest. A cutting clearance of about 3 to about 5 μm can be provided between the punching knife 34 of the punch 23 and the opening 35 of the die 24.

Figure 4:
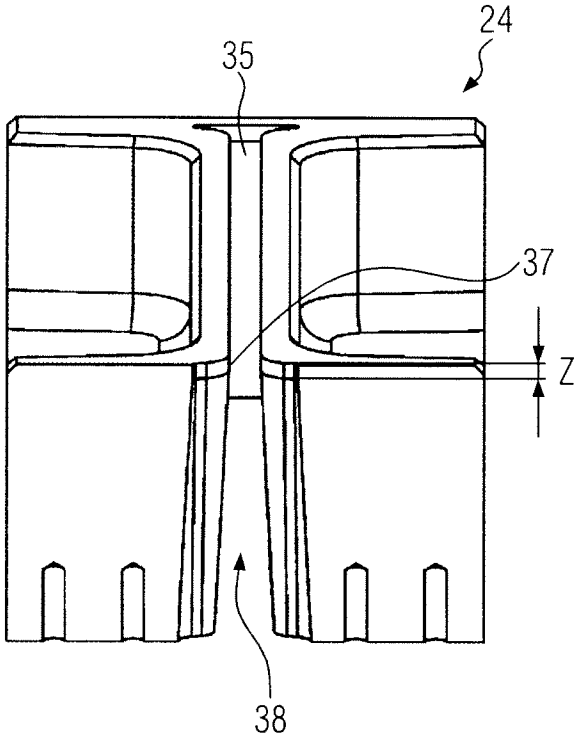
FIG. 4 is a sectional view of the die of FIG. 3.

FIG. 4 shows the die 24 in a sectional view in a direction transversely to the working direction R of the thermoform packaging machine 1 at the center of the die 24. As shown, the opening 35 has in the upper area thereof a planar punching area 37, which extends parallel to the direction of movement of the punch 23 and the die 24. The punching area 37 can have a width Z of at least about 3 mm. Below this punching area 37, the opening has a free space 38 so that film strips 32 can drop more easily.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a film punch unit including a die and a punch;

a motor for simultaneously moving the die and the punch during a working cycle of said film punch unit, said motor operable to simultaneously move the die and the punch towards each other such that the die and the punch engage to cut a film with a first driving movement of the motor in a first portion of a working cycle of said film punch unit, and said motor operable to simultaneously move the die and the punch away from each other with a second driving movement of the motor to define clear distance to allow an advance of said film in a second portion of said working cycle of said film punch unit, wherein the movement of the die and the punch is orthogonal to a film conveying plane;

a first stroke mechanism operably connecting the motor to the punch; and a second stroke mechanism operably connecting the motor to the die;

wherein the motor is disposed above the film conveying plane and one of the punch or the die are disposed below the film conveying plane.

2. The thermoform packaging machine according to claim 1, wherein the motor comprises an electric motor.

3. The thermoform packaging machine according to claim 2, wherein the electric motor is a servo motor.

4. The thermoform packaging machine according to claim 1, wherein the first stroke mechanism is arranged fully above the film conveying plane.

5. The thermoform packaging machine according to claim 1, wherein the film punch unit further includes a stationary frame, and the second stroke mechanism includes a bearing plate operably connected to the die, wherein the motor is operably connected to the bearing plate such that the bearing plate moves relative to the frame during movement of the motor.

6. The thermoform packaging machine according to claim 1, wherein the punch comprises a punching knife.

7. The thermoform packaging machine according to claim 6, wherein the punch and the punching knife are each configured as a multi-part component.

8. The thermoform packaging machine according to claim 1, wherein the die comprises an opening.

9. The thermoform packaging machine according to claim 8, wherein the opening is produced by at least one of wire eroding and grinding.

10. The thermoform packaging machine according to claim 1, wherein the die comprises a plurality of cavities.

11. The thermoform packaging machine according to claim 10, wherein the cavities each have a height of up to 60 mm.

12. The thermoform packaging machine according to claim 10, wherein the cavities each have a depth of between 30 mm and 40 mm.

13. The thermoform packaging machine according to claim 1, wherein the film punch unit is configured for separating a film strip from a composite film using the punch and the die, and for conveying the film strip downwards through the die.

14. The thermoform packaging machine according to claim 1, wherein the punch is configured such that it is movable vertically downwards and the die is configured such that it is movable vertically upwards, for executing a punching process.

15. The thermoform packaging machine according to claim 1 further comprising a container below the die for receiving film strips therein.

16. The thermoform packaging machine according to claim 1, further comprising a film feeding device for delivering a packaging film to the film punch unit.

17. The thermoforming packaging machine according to claim 1 further comprising a sealing station.

18. A thermoform packaging machine comprising:

a packaging film feeding device to convey a packaging film in a film conveying plane;

a film punch unit including a die and a punch;

a single drive device that generates a driving power for simultaneously moving the die and the punch during a working cycle of said film punch unit to engage each other to cut the packaging film, wherein the single drive device is disposed above the film conveying plane;

a first stroke mechanism comprising a first mechanical linkage, a first end of the first stroke mechanism is operably connected to the single drive device and a second end of the first stroke mechanism is operably connected to one of the die or the punch for transmitting the driving power of the single drive device to the one of the die or the punch to result in a first linear movement; and a second stroke mechanism comprising a second mechanical linkage, a first end of the second stroke mechanism is operably connected to the single drive device and a second end of the second stroke mechanism is operably connected to the other one of the die or the punch for transmitting the driving power of the single drive device to the other one of the die or the punch to effectuate a second linear movement, and wherein the other one of the die or the punch is disposed below the film conveying plane;

said single drive device operable to simultaneously move the die and the punch towards each other to cut the packaging film with a first driving movement of the single drive device in a first portion of the working cycle of said film punch unit, and said single drive device operable to simultaneously move the die and the punch away from each other with a second driving movement of the single drive device to position said die and the punch to allow an advance of said packaging film during a second portion of said working cycle of said film punch unit, and wherein the movement of the die and the punch in the first and second portions of the working cycle of the film punch unit is orthogonal to the film conveying plane.

19. The thermoforming packaging machine according to claim 18 further comprising a sealing station.

* * * * *